United States Patent [19]

Umeha et al.

[11] Patent Number: 4,863,513

[45] Date of Patent: Sep. 5, 1989

[54] IRON-BASE ANTI-WEAR SINTERED ALLOY MEMBER

[76] Inventors: Genkichi Umeha, 4-22-28, Shimotakaido, Suginami-Ku, Tokyo; Shigeru Urano, 477, Aza-Maedori Oaza-Uedayahon, Omiya-Shi, Saitama-Ken; Osamu Hirakawa, 4-19-9, Hon-Cho-Nishi, Yono-Shi, Saitama-Ken; Shunsuke Takeguchi, Azuma-So, 844, Yono, Yono-Shi, Saitama-Ken, all of Japan

[21] Appl. No.: 96,292

[22] Filed: Sep. 8, 1987

Related U.S. Application Data

[63] Continuation of Ser. No. 740,848, May 17, 1985.

[30] Foreign Application Priority Data

Sep. 28, 1983 [JP] Japan ..... 58-178185

[51] Int. Cl.[4] ..... C22C 38/08; C23C 22/07; B32B 15/00

[52] U.S. Cl. ..... 75/231; 75/237; 428/472.3

[58] Field of Search ..... 75/245, 246, 231 AB, 75/237; 148/31.5, 6.15 R; 428/472.3

[56] References Cited

U.S. PATENT DOCUMENTS

| | | | |
|---|---|---|---|
| 2,731,360 | 1/1956 | Love | 148/6.15 R |
| 2,979,430 | 4/1961 | Keller et al. | 148/6.15 R |
| 3,248,251 | 4/1966 | Allen | 75/231 |
| 3,450,578 | 6/1969 | Siemund et al. | 148/6.15 R |
| 3,562,023 | 2/1971 | Courier | 148/6.15 R |
| 3,767,386 | 10/1973 | Ueda et al. | 75/123 D |
| 4,243,414 | 1/1981 | Takahashi et al. | 75/244 |
| 4,253,874 | 3/1981 | Cundill | 75/246 |
| 4,268,309 | 5/1981 | Serino et al. | 75/230 |

*Primary Examiner*—John F. Terapane
*Assistant Examiner*—Eric Jorgensen

[57] ABSTRACT

An iron-based anti-wear sintered alloy member containing at least 1.5 weight % C, 0.5 to 3.5 weight % P, and one or both of Mo and W in an amount of 0.5 to 3.0 weight % in terms of Mo (the conversion rate of W being 0.5) in addition to iron and having a phosphatic film formed at sliding contact portions. In addition to the above-described elements, one or both of Ni and Cu may be incorporated in an amount of 0.5 to 5.0 weight % in terms of Ni (the conversion rate of Cu being 0.5), of 0.3 to less than 8.0 weight % of Cr may be incorporated, or one or both of Ni and Cu may be incorporated in an amount of 0.3 to 0.7 weight % in terms of Ni together with 0.3 to 0.7 weight % of Cr.

3 Claims, 2 Drawing Sheets

IRON-BASE ANTI-WEAR SINTERED ALLOY MEMBER

This application is a continuation of application Ser. No. 740,848 filed on May 17, 1985.

TECHNICAL FIELD

The present invention relates to an anti-wear sintered alloy member for use in an internal combustion engine and the like, and more particularly to a sintered alloy member suitable for use as a cam lo be in a composite camshaft of the type having cam lobes and journals of a material sintered in a liquid phase.

BACKGROUND ART

A sintered alloy member, such as a cam lobe of a camshaft, is subjected in service to a high plane pressure and therefore is required to be highly abrasion-resistant. For the purpose of increasing the anti-wear property of the sintered alloy member, B, Cu, Nb, V and the like are added to produce a hard precipitation dispersed in the matrix of the alloy member. Otherwise, Mo, Ni and the like are added to harden the matrix. However, this leads to a problem that the obtained anti-wear sintered alloy member readily scuffs the opposing member under poor lubrication in the starting up period in which the oil film has not yet been sufficiently formed to cover the entire sliding surface. For protecting the opposing member against scuffing, it has been suggested to cover the sliding surface of the anti-wear sintered alloy member with a phosphatic film.

But, in the case of a member made of a material containing a relatively large amount of Cr and/or Ni, it is very difficult to form a sufficient film of phosphate over the sliding surface, resulting in the fact that the phosphatic treatment is ineffective in protecting the opposing member against scuffing.

The present invention is intended to resolve the problem as described above and provide an anti-wear sintered alloy member wherein the sliding surface is sufficiently coated by a phosphatic film, whereby the inventive member is superior in its anti-scuffing property.

DISCLOSURE OF THE INVENTION

To attain the object as described above, the invention consists in an anti-wear sintered alloy member having the material composition of 1.5–3.5 weight % of C; 0.3–1.0 weight % of P; 0.5–3.0 weight %, in terms of Mo, of at least one of Mo and W; and the balance of Fe and the sliding surface thereof coated by a phosphatic film. The conversion rate of W is 0.5. The reason for and the amount of addition of C, P, Mo and W is described hereinbelow.

Carbon is solid-solved in the matrix to increase the strength and the wear resistance of the matrix. When the amount of C is less than 1.5 weight %, the cementite is insufficient in amount to give a desired anti-wear property to the member. When the amount of C exceeds 3.5 weight %, it leads to an alloy member material which yields a liquid-phase at too low temperature and precipitates graphite to make the material more brittle.

Phosphorus is added to cause the alloy member material to easily yield a liquid phase. When the amount of P is less than 0.3 weight %, it is too small to obtain an easy liquid-phase formation. On the other hand, more than 1.0 weight % of P is not practical. The reason for this is that the material embrittles due to excessively produced steadite and that the member has too large a rate of shrinkage or deformation.

Molybdenum not only increases the strength of the matrix but also improves abrasion resistance by forming a hard carbide. When the amount of Mo is less than 0.5 weight %, it is solid-solved in the steadite and exhausted to form a quaternary eutectic, thereby failing to strengthen the matrix. No more than 3.0 weight % of Mo is needed to strengthen the matrix and form a quaternary eutectic which is effective in improving the abrasion-resistant property of the alloy member.

Molybdenum is fully or partly substituted by Tungsten which has the same effect as Molybdenum. However, the latter is equivalent in effect to the half of the former. This means that one part of Mo should be replaced by two parts of W.

The alloy member, containing none of Ni and Cr which are destructive to the phosphatic treatment, has its sliding surface sufficiently phosphatized to prevent scuffing deriving the starting period. It contains a sufficient amount of C to harden the matrix and additives of Mo and/or W to increase the wear resistance, thereby being highly abrasion-resistant when used as a cam lobe of a camshaft.

The object of the present invention can be attained by a alloy member containing such an amount of at least one of Ni, Cu, and Cr that is too small to prevent the sufficient formation of a phosphatic film. The reason and the amount of addition of these materials are described below.

Nickel is added to strengthen the matrix by forming banite or martensite. When the amount of Ni is less than 0.5 weight %, the strength of the matrix will insignificantly increase. More than 5.0 weight % of Ni makes the matrix corrosion-resistant to the extent that the sliding surface is prevented from being sufficiently coated by a phosphatic film, thereby decreasing an effective protection against scuffing. Thus, the amount of Ni is limited to 0.5–5.0 weight %.

Copper, having the same effect as Ni, can fully or partly replace Ni. However, Cu is equivalent in effect to the half of Ni. This means that Cu can be added in an amount double that of Ni.

Chromium is added to increase the abrasion-resistant property by precipitating a carbide. When the amount of Cr is less than 0.3 weight %, the increase of the abrasion resistance will not be significant. However, when the amount of Cr is more than 8 weight %, the matrix is too corrosion-resistant to be sufficiently phosphatized, resulting in that the insufficient phosphatic film on the sliding surface will be inferior in its protection against scuffing. A combination of Cr and Ni will increase the corrosion resistance of the matrix but prevent the adequate formation of a phosphatic film. Therefore, the amount of Cr is not to exceed 7.0 weight % in the case of the alloy member containing both of Ni and Cr.

The addition of less than 2.0 weight % of at least one of Nb, V, and B improves the matrix in the abrasion-resistant property by hardening the matrix and precipitating a carbide.

From the foregoing, in comparison with the conventional alloy member containing at least one of Cr and Ni in an amount where a phosphatic film is prevented from sufficiently covering the sliding surface of the alloy member, the anti-wear sintered alloy member of the present invention either excludes or contains Ni and/or Cr in a small amount so that the sliding surface of the alloy member can be sufficiently coated by a phosphatic film. Although the inventive alloy member is made from a material containing a relatively small amount of Ni and Cr which are effective to improve the abrasion resistant prooperty, it is highly abrasion-resistant due to a synergetic effect of elements contained in the alloy member material. The advantages offered by the present invention are mainly that the sliding surface of the alloy member is effectively protected against scuffing and that the inventive alloy member, excluding Ni and Cr or including a relatively small amount of these materials is similar to or somewhat higher than the conventional abrasion-resistant sintered alloy member containing a relatively large amount of Ni and/or Cr.

THE BEST MODE CARRYING OUT THE INVENTION

A test for comparison between the inventive and conventional anti-wear sintered alloys is performed.

Examples I, II, III, and IV are cam lobes of the invention and Example V is one of the conventional alloy member, each having the same density of 7.6 g/cubic cm. The composition and hardness of each Example are shown in Table 1. The sliding surface of each example is phosphatized by coating with a phosphatic film. The treatment using a chemical conversion treatment liquid containing manganese phosphate 140 g/liter (LUBRITE A1 by Nippon Parkerizing K. K.) was carried out at 96° C. for 60 minutes. As seen in the 200-magnification SUMP-microphotographs of FIGS. 1 to 4, a sufficient amount of white phosphates are formed on the sliding surface.

TABLE 1

| | CAM LOBE | | | | | |
|---|---|---|---|---|---|---|
| | COMPOSITION (weight %) | | | | | HARDNESS |
| EXAMPLE | C | P | Mo | Ni | Cr | HRC |
| I | 2.4 | 0.8 | 1.5 | — | — | 44 |
| II | 2.5 | 0.5 | 1.5 | 2.5 | — | 57 |
| III | 2.2 | 0.4 | 1.0 | — | 7.5 | 53 |
| IV | 2.3 | 0.6 | 1.0 | 2.0 | 4.0 | 54 |
| V | 2.1 | 0.5 | 1.0 | 2.0 | 16.5 | 58 |

Each Example was mounted on a common camshaft of a gasoline engine and tested as follows:

Test Engine: water-cooled four cylinder OHC-type 1800 cc gasoline engine

Running Condition: Number of revolution: 1,200 rpm

Lubricating Oil: SAE #30 Running time: 100 hours

Tappet: hardened cast iron having the composition shown in TABLE 2

TABLE 2

| | TAPPET | | | | | |
|---|---|---|---|---|---|---|
| | COMPOSITION (weight %) | | | | | HARDNESS |
| C | Si | Mn | Ni | Cr | Mo | RHC |
| 3.3 | 2.1 | 0.7 | 0.3 | 0.9 | 0.5 | 58 |

Figure 1:
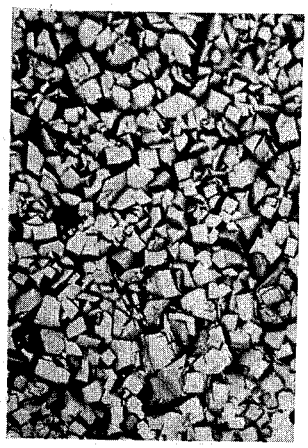
FIGS. 1 to 4 are 200-magnification SUMP-photomicrographs, respectively illustrating the sliding surface of each anti-wear sintered alloy member obtained in the Examples according to the present invention.
Figure 2:
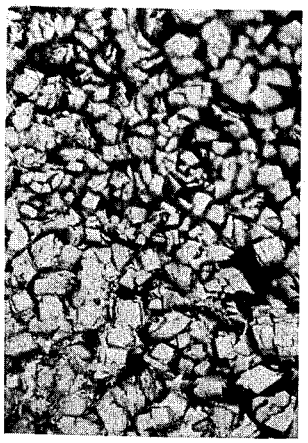
Figure 3:
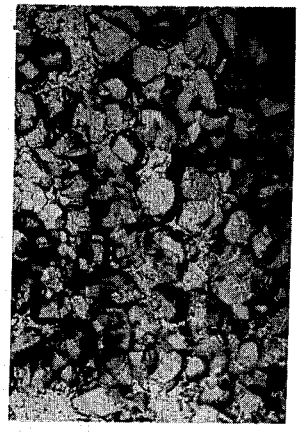
Figure 4:
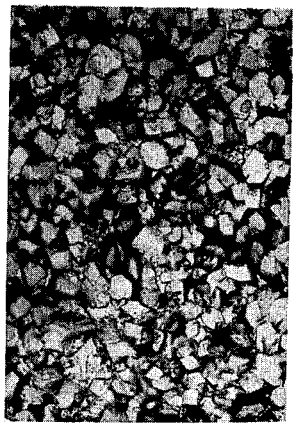
Figure 5:
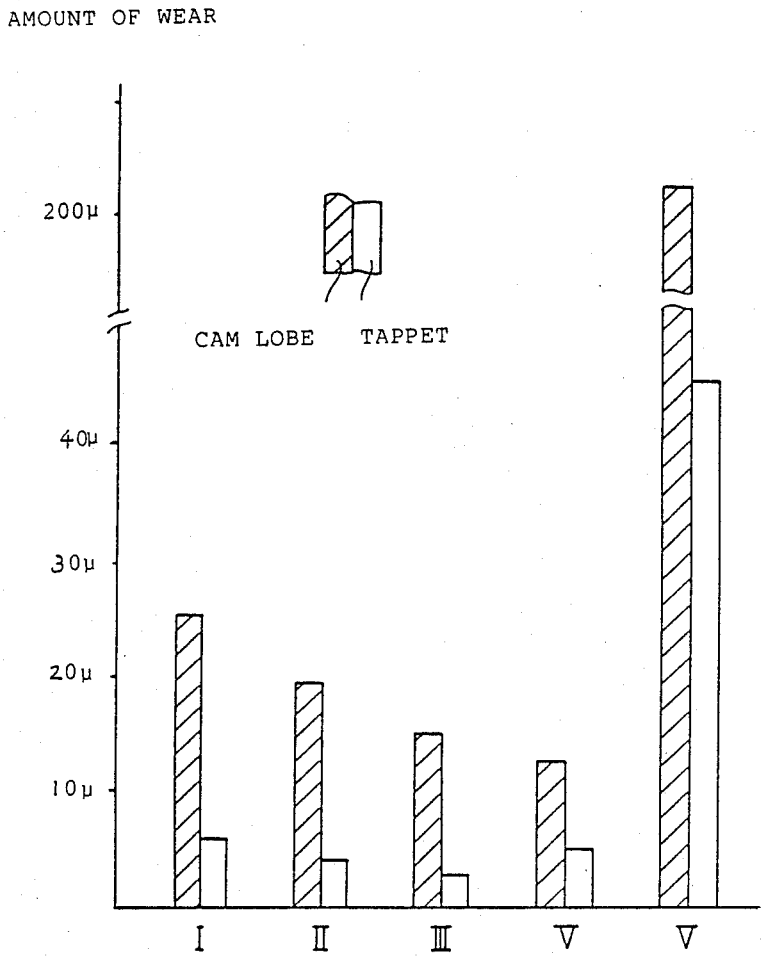
FIG. 5 graphically illustrates, as the result of engine tests, the amount of wear between the cam lobe and tappet of the present invention and comparative Examples.

After a 100-hour running test, the amount of wear of between the sliding surfaces of the cam lobe and tappet of each Example is measured and plotted in FIG. 5. The graph shows that the amount of wear of the inventive Examples I to IV is much less than the comparative Example V. This means that scuffing has taken place between the paired sliding surfaces of Example V. and that no scuffing occurs between the paired sliding surface of the inventive Examples. The opposite sliding member such as a tappet or the like is preferable to have composition shown in TABLE 3.

TABLE 3

| (weight %) | |
|---|---|
| TC | 2.8–3.50 |
| Si | 1.50–2.50 |
| Mn | 0.50–1.00 |
| P | less than 0.30 |
| S | less than 0.10 |
| Ni/Cr | 0.20–0.80 |
| Cr | 0.70–1.60 |
| Mo | 0.20–0.80 |
| V | less than 0.50 |
| B | 0.005–1.10 |

We claim:

1. An iron-base anti-wear sintered alloy member having substantially no chromium containing 1.5–3.5 weight % C, 0.3–1.0 weight % of P, at least one of 0.5–3.0 weight % of Mo and 1.0–6.0 weight % of W, and the balance being Fe, said member having the sliding surface thereof coated by a phosphatic film.

2. The iron-base anti-wear sintered alloy member of claim 1 further containing less than 2.0 weight % of at least one of Nb, V and B.

3. An iron-base anti-wear sintered alloy member having substantially no chromium containing 1.5–3.5 weight % of C, 0.3–1.0 weight % of P, at least one of 0.5–3.0 weight % of Mo and 1.0–6.0 weight % of W 0.5–5.0% of at least one of Ni and Cu, and the balance being Fe, said member having the sliding surfaces thereof coated by a phosphatic film.

* * * * *